United States Patent [19]

Heims

[11] Patent Number: 4,991,995

[45] Date of Patent: Feb. 12, 1991

[54] LAYING PLANK FOR A ROAD FINISHING MACHINE

[75] Inventor: Dirk Heims, Bad Münder, Fed. Rep. of Germany

[73] Assignee: ABG-Werke GmbH, Fed. Rep. of Germany

[21] Appl. No.: 389,400

[22] Filed: Aug. 4, 1989

[30] Foreign Application Priority Data

Nov. 10, 1988 [DE] Fed. Rep. of Germany ..... 3838157

[51] Int. Cl.[5] ..... E01C 19/22

[52] U.S. Cl. ..... 404/118

[58] Field of Search ..... 404/118, 101

[56] References Cited

U.S. PATENT DOCUMENTS

| | | | |
|---|---|---|---|
| 3,957,384 | 5/1976 | Lamb et al. | 404/118 |
| 3,992,124 | 11/1976 | Schrader | 404/118 |
| 4,272,213 | 6/1981 | McGovarin | 404/118 |
| 4,345,852 | 8/1982 | Goto et al. | 404/114 |
| 4,379,653 | 4/1983 | Brown | 404/118 |
| 4,702,642 | 10/1987 | Musil | 404/118 |

FOREIGN PATENT DOCUMENTS

| | | | |
|---|---|---|---|
| 2024900 | 1/1980 | United Kingdom | 404/118 |

*Primary Examiner*—William P. Neuder

*Attorney, Agent, or Firm*—Townsend and Townsend

[57] ABSTRACT

The invention relates to a laying plank for a road finishing machine comprising a basic plank (1) which exhibits two central upright cheeks (2) to which an extension cylinder (3) is attached on each side which guides an inner movable cheek (8) of an extensible plank (4) for the lateral prolongation of the basic plank (1) and engages an outer movable cheek (5) for extending, at least one guide rod (6) parallel to the cylinder axis being provided respectively between inner and outer movable cheeks (5, 8), which is guided by an outer cheek (7) connected firmly to the basic plank (1). In order that the extensible planks can be extended by half the width of the basic plank, it is provided that at least two guide rods (10, 11) parallel to the cylinder axis are arranged outside the region of the outer stationary cheek (7) between inner and outer movable cheeks (5, 8), which guide two guide cheeks (12) arranged at a mutual interval and connected to the extensible plank (4), a guide rod (11) being embraced by a cylinder (13) connected to the guide cheeks (12) and provided with an annular piston (14) stressable on both sides, and the stroke of the cylinder (13) corresponding substantially to the interval between the inside of the inner cheek (8) and the outside of the basic plank (1) in the extendded state of the extensible plank (4).

10 Claims, 2 Drawing Sheets

LAYING PLANK FOR A ROAD FINISHING MACHINE

The invention relates to a laying plank for a road finishing machine.

Road finishing machines are generally equipped with a basic plank and with two extensible planks, the latter being extensible each to one side of the road finishing machine to conform to the width of the material to be laid. In this case, however, an enlargement to twice the width of the basic plank is prevented by the necessary guide and bracing means of the extensible planks.

The object of the invention is to develop a laying plank which permits an enlargement to each side by virtually half the width of the basic plank.

Further developments of the invention are to be found in the following description and in the subordinate Claims.

The invention is explained more fully below with reference to the exemplary embodiment shown in the accompanying drawings.

Figure 1:
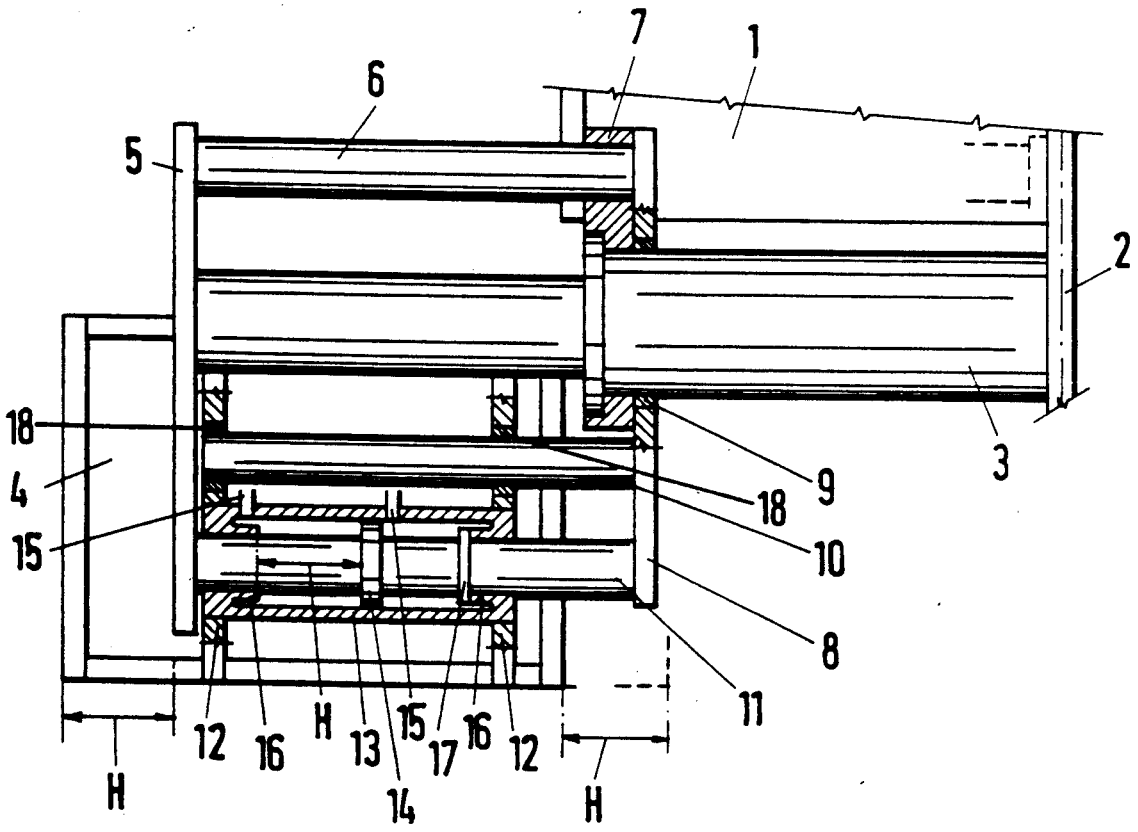
FIG. 1 shows a laying plank diagrammatically in plan and as a detail.

The laying plank shown comprises a basic plank 1 of predetermined width, which is arranged on a road finishing machine and connected to two central upright cheeks 2, the main planes of which extend in the direction of travel of the road finishing machine. An extension cylinder 3 extending laterally outwards is fastened to each side of the central cheeks 2, and said cylinders are connected to pressurised medium pipes, not shown, to retract and extend them. The two extension cylinders 3 serve to extend extensible planks 4, which are arranged behind the basic plank 1 in the retracted state and which have half the width of the basic plank 1.

The extensible planks 4 each comprise an outer movable cheek 5 which is engaged by the respective extension cylinder 3, and an inner movable cheek 8 connected to it by at least one guide rod 6, which is guided by an outer cheek 7 connected firmly to the basic plank 1. The cheek 8 houses a bearing bushing 9 which embraces the extension cylinder 3 and ensures the guidance of the cheek 8 by the extension cylinder 3. The extension cylinder 3 is connected firmly by a flange 3' at the outer end to the adjacent cheek 7. The flange 3' is set back, convenently by the thickness of the cheek 5, relative to the outer edge of the basic plank 1, so that when the extensible plank 4 is retracted its outer edge is in alignment with that of the basic plank 1.

At least two guide rods 10, 11 are arranged parallel to the axis of the extension cylinder 3 outside the region of the outer stationary cheek 7, between the inner and outer movable cheeks 5, 8. The axes of the extension cylinders 3 and of the guide rods 6 are conveniently staggered mutually in the vertical direction, like the axes of the guide rods 10, 11, in order to achieve greater stability and rigidity.

The guide rods 10, 11 guide two guide cheeks 12 connected to the extensible plank 4 and arranged at an interval from each other, the guide rod 11 being surrounded by a cylinder 13 connected to the guide cheeks 12. The guide rod 11 also carries a fixed annular piston 14, whereas the cylinder 13 is provided on both sides of the annular piston 14 with pressurised medium feed pipes 15 to stress the annular piston 14 on both sides in order to transport the cylinder 13, and therefore the extensible plank 4, relative to the guide rod 11.

The stroke H of the cylinder 13 corresponds to the interval between the inside of the inner cheek 8 and the outside of the basic plank (1) in the extended state of the extensible plank 4, plus half the thickness of the central cheek 2, so that the extensible plank 4 can be extended exactly by half the width of the basic plank 1.

The cylinder 13 has at each of its two end faces an inward-facing annular stop 16 which embraces the guide rod 11 and has a diameter smaller than the inside diameter of the cylinder 13. The stop 16 located at the outer end of the cylinder 13 co-operates with the annular piston 14 to limit the stroke of the cylinder 13 in the retracting direction. In order that the cylinder 13 can be extended from the retracted position, the corresponding pressurised medium feed pipe 15 leads into the region between stop 16 and cylinder inner wall.

The guide rod 11 carries a further ring 17 which acts as a stop to limit the stroke of the cylinder 13 in the extending direction and co-operates with the stop 16 of the cylinder 13 at its inner end. The ring 17 and the stop 16 have an equal outside diameter. When the cylinder 13 is stressed for retraction, only a part of the pressure-stress surface becomes effective at first, because a part is masked by the ring 17. Only after the stop 16 has lifted from the ring 17 does the full surface become effective. A gentle movement start is obtained by this means, as in the case of the extension start, in which only a smaller surface likewise becomes effective at first.

The cheek 5 may also be used instead of the ring 17 as a stop for the movement of the cylinder 13 relative to the guide rod 11. Similarly the cheek 8 may be used instead of the annular piston 14 as a stop in the retracting direction.

A sequence circuit for consecutive actuation may be provided for the two cylinders 3, 13, however this may also be omitted. In that case the cylinder with the lowest friction retracts or extends first.

The guide cheeks 12 are conveniently guided by bearing bushings 18 relative to the guide rod/s 10.

Figure 2:
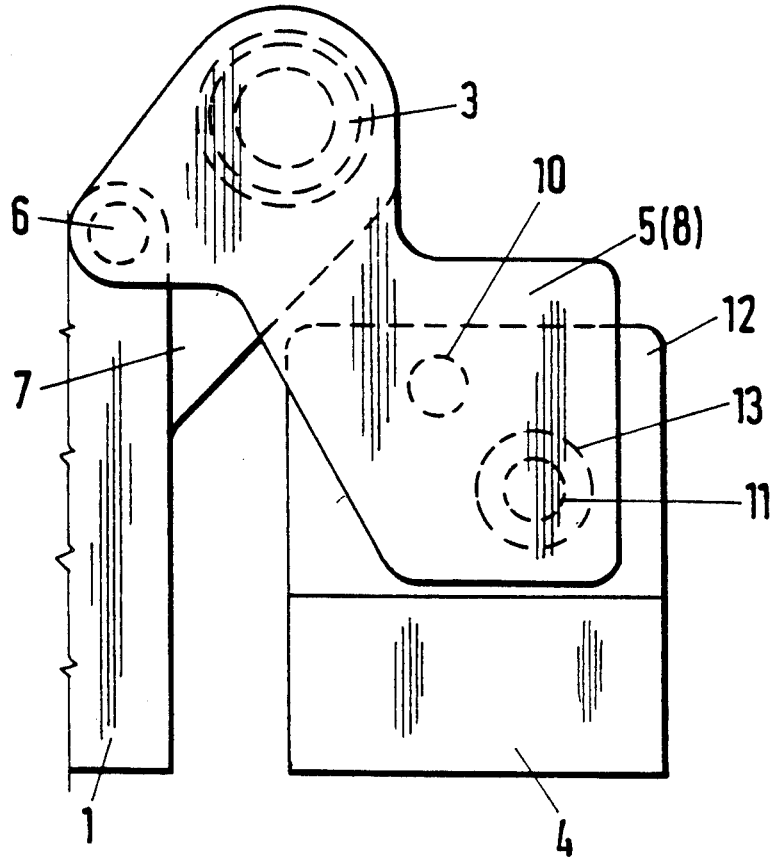
FIG. 2 shows a side elevation of the laying plank of FIG. 1.

As FIG. 2 shows, the cheeks 7, 8 and 12 are constructed so that the guide rods 6 and the cylinder 3 extend only between the stationary cheek 7 and the outer movable cheek 5, whereas the guide rods 10, 11 extend only between the movable cheeks 5, 8 and the movement of the guide cheeks 12 is not obstructed by the cheek 7. Similarly the retraction of the extensible plank 4 is not obstructed by the outer cheek 5.

The cheeks 2 are not strictly necessary in this construction, because the forces can be absorbed by the outer stationary cheek 7.

I claim:

1. Laying plank for a road finishing machine comprising:

a centrally divided basic plank having a respective left-hand and right-hand half, an inward direction oriented from each half toward the other half and an outward direction oriented away from the other half, each half including a central upright cheek and an extension cylinder attached to said central upright cheek;

an extensible plank for elongation of said basic plank when said extensible plank is in an extended state, said extensible plank including an inner movable cheek guided by said extension cylinder and engaging an outer movable cheek;

a first guide rod disposed parallel to the axis of the extension cylinder between said inner and outer movable cheeks;

an outer stantionary cheek fixed to said basic plank for guiding said first guide rod;

two second guide rods disposed parallel to the axis of the extension cylinder between the inner and outer movable cheeks and outward of the outer stationary cheek;

two guide cheeks guided by said second guide rods, said guide cheeks spaced form each other and connected to said extensible plank; and a cylinder embracing one of said second guide rods, connected to said guide cheeks and including an annular piston stressable on both sides to move said extensible plank in a stroke, said stroke corresponding substantially to the interval between the inward surface of the inner movable cheek and the outward surface of said basic plank when said extensible plank is in the extended state.

2. Laying plank according to claim 1, wherein the guide rods arranged mutually staggered in the vertical direction.

3. Laying plank according to claim 1, wherein the annular piston of the guide rod forms a stop to limit the stroke of the cylinder in the retracting direction.

4. Laying plank according to claim 2, wherein the annular piston of the guide rod forms a stop to limit the stroke of the cylinder in the retracting direction.

5. Laying plank according to claim 3, wherein the cylinder comprises a hollow cylinder including as top having an outer diameter smaller than the inner diameter of the cylinder, the stop embracing the guide rod, being in engagement with the annular piston in the retracted position, and having a pressurized medium feed pipe leading into the region between the stop and the inner wall of the cylinder.

6. Laying plank according to claim 4, wherein the cylinder comprises a hollow cylinder including a stop having an outer diameter smaller than the inner diameter of the cylinder, the stop embracing the guide rod, being in engagement with the annular piston in the retracted position, and having a pressurized medium feed pipe leading into the region between the stop and the inner wall of the cylinder.

7. Laying plank according to claim 1, wherein the cylinder comprises a hollow cylinder and an inner annular stop being smaller in diameter than the inside of the cylinder, and further comprising a ring disposed on the guide rod and having a diameter equal to the diameter of the inner annular stop, said ring being in engagement with said inner annular stop in the extended position of the extensible plank.

8. Laying plank according got claim 2, wherein the cylinder comprises a hollow cylinder and an inner annular stop being smaller in diameter than the inside of the cylinder, and further comprising a ring disposed on the guide rod and having a diameter equal to the diameter of the inner annular stop, said ring being in engagement with said inner annular stop in the extended position of the extensible plank.

9. Laying plank according to claim 5 wherein the cylinder comprises an inner annular stop being smaller in diameter than the inside of the cylinder, and further comprising a ring disposed on the guide rod and having a diameter equal to the diameter o the inner annular stop, said ring being in engagement with said inner annular stop in the extended position of the extensible plank.

10. Laying plank according to claim 6 wherein the cylinder comprises an inner annular stop being smaller in diameter than the inside of the cylinder, and further comprising a ring disposed on the guide rod and having a diameter equal to the diameter of the inner annular stop, said ring being in engagement with said inner annular stop in the extended position of the extensible plank.

* * * * *